US006346005B1

(12) United States Patent
Viklund et al.

(10) Patent No.: US 6,346,005 B1
(45) Date of Patent: Feb. 12, 2002

(54) REDUCED CROSS-TALK HIGH FREQUENCY WIRING CONNECTION SYSTEM

(75) Inventors: Mark Viklund, New Milford; Ann M. Casper, Roxbury; Olindo J. Savi, Berlin, all of CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 09/008,757

(22) Filed: Jan. 19, 1998

(51) Int. Cl.[7] ..... H01R 4/24
(52) U.S. Cl. ..... 439/404
(58) Field of Search ..... 439/404, 405, 439/608, 49, 532, 709, 715, 719, 922

(56) References Cited

U.S. PATENT DOCUMENTS

| | | | | |
|---|---|---|---|---|
| 4,262,985 A | * | 4/1981 | Muehlhausen, II | 439/401 |
| 4,533,196 A | * | 8/1985 | Forberg et al. | 439/404 |
| 5,160,273 A | | 11/1992 | Carney | 439/108 |
| 5,226,835 A | * | 7/1993 | Baker, III et al. | 439/403 |
| 5,324,211 A | | 6/1994 | Siemon et al. | 439/404 |
| 5,328,380 A | | 7/1994 | Carney | 439/188 |
| 5,372,519 A | * | 12/1994 | Chen | 439/395 |
| RE35,030 E | * | 8/1995 | Siemon et al. | 439/532 |
| 5,494,461 A | | 2/1996 | Bippus et al. | 439/709 |
| 5,588,849 A | * | 12/1996 | Kile | 439/83 |
| 5,591,045 A | * | 1/1997 | Pepe et al. | 439/460 |
| 5,601,447 A | * | 2/1997 | Reed et al. | 439/404 |
| 5,645,445 A | * | 7/1997 | Siemon et al. | 439/395 |
| 5,772,472 A | * | 6/1998 | Beutler et al. | 439/608 |
| 5,975,919 A | | 11/1999 | Arnett et al. | |
| 6,113,418 A | | 9/2000 | Kjeldahl | |
| 6,139,352 A | * | 10/2000 | Daoud | 439/404 |

FOREIGN PATENT DOCUMENTS

JP 182350 4/1992

OTHER PUBLICATIONS

Lucent Technologies, Certified SYSTIMAX® SCS Component, Jan. 14, 1998, sketch of contacts.
ICC Patch Cord Solutions, sketch of contacts.
AMP, 110ConnectXC Patch Plugs, Sep. 1996; sketch of contacts.
Panduit™, Pan–Punch™ 110 Punchdown System, date unknown; sketch of contacts.
AMP, 110Connect XC Cross Connect System, Mar. 1995.
UTP Patching, KATT Premises Distribution System (PDS), date unknown.

* cited by examiner

*Primary Examiner*—Brian Sircus
*Assistant Examiner*—Thanh-Tam Le
(74) *Attorney, Agent, or Firm*—Cantor Colburn LLP

(57) ABSTRACT

A wiring connecting system having superior electrical transmission performance with reduced cross talk and improved lacing and termination features is disclosed and includes a base, a wire strip mountable to the base, a connecting block for housing a plurality of electrical contacts and a plurality of cross talk barriers disposed within the connecting block for isolating pairs of the electrical contacts. The wire strip has a plurality of first and second posts alternating along its length. The second posts have a greater width than the first posts. A connecting block for housing a plurality of electrical contacts mounts onto the wire strip. An upper end of the connecting block includes a plurality of first and second teeth alternating along its length with the second teeth have a greater width than the first teeth. The electrical contacts extend from the lower end of the housing to generally align with the openings of the wire strip. A plurality of barriers for electrically shielding pairs of the electrical contacts are disposed within the connecting block housing and substantially surround respective pairs of the electrical contacts. A plug for connecting a cable having a plurality of wires to the connecting block is also disclosed.

22 Claims, 14 Drawing Sheets

REDUCED CROSS-TALK HIGH FREQUENCY WIRING CONNECTION SYSTEM

BACKGROUND OF THE INVENTION

1. Field of the Invention

This invention relates generally to telecommunication wiring systems for use in the communications industry. More specifically, this invention relates to an improved wiring connecting system having superior electrical transmission performance with reduced cross talk and improved lacing and termination features.

2. Prior Art

Prior art wire connecting systems or wiring blocks are well known and commercially available from AT&T, now Lucent Technologies, Inc., as the 110 connector system. The 110 wire connecting systems are described in several patents including U.S. Pat. Nos. 3,611,264; 3,798,581 and 4,118,095. The 110 type wiring block comprises a base having a plurality of legs at each end thereof. The legs provide a space behind the wiring block (when mounted) for cables that are to be terminated on the wiring block. The wiring block includes a base having a plurality of spaced longitudinal slots. A wiring strip is secured to the base within the slots by a plurality of posts. Connector blocks having Insulation Displacement Contacts (IDC's) housed within are mounted on the wire strips. Wires terminated at 110 wiring blocks may be terminated at the wiring strips and at the connector blocks for electrical contact with the IDC's of the connector blocks. The use of IDC's in which the wires are punched into the IDC maximizes density and facilitates ease of use. Various improvements to such 110 connector systems have been made since their initial development, including the feature of using detachable legs, as described in U.S. Pat. No. Re. 35,030.

In a typical wiring application, backbone cabling (such as from outside a building or from a main bus within the building to a particular floor) is terminated at a primary distribution point where 110 wiring blocks are employed. Horizontal cabling from various end-user equipment or communications networking, e.g. computers, phones, networks and the like, is also terminated at the distribution point at 110 wiring blocks. The 110 type connecting systems are designed to support digital data transmission as well as analog/digital voice over unshielded twisted pair (UTP) media through the use of wiring blocks, connector blocks and patch cords or jumpers. This system facilitates moves, additions and rearrangements of circuits connected to end-users or equipment to provide a flexible means of connecting horizontal and backbone cabling within a building.

With increased rates of transmission, a higher performance wiring block is needed to minimize near end transmission cross talk between IDC pairs. The problem of cross talk is not very severe at low frequencies (around 16 MHZ), however, as the rate of transmission increases up to 400 MHZ, the radiation is higher and there is a greater need to reduce this cross talk. Prior art attempts to reduce this cross talk have utilized conductive shields (plates) between pairs. U.S. Pat. Nos. 5,160,273, 5,324,211 and 5,328,380 are examples of the use of such plates. However these prior art attempts do not surround and/or isolate the IDC pairs and thus reduction of cross talk is not optimized. Another limitation of these prior art devices is that difficulty is encountered when lacing and punching down twisted pair wiring. The tips of the 110 type blocks between the IDC pairs are typically blunt and require untwisting of the wire prior to lacing into the block. This leads to excessive untwist in the pair and loss of electrical performance. Thus, there is a need in the industry for an improved wiring connecting system having superior electrical transmission performance with reduced cross talk and improved lacing and termination features.

SUMMARY OF THE INVENTION

The above-discussed and other drawbacks and deficiencies of the prior art are overcome or alleviated by the wiring connecting system of the present invention. In accordance with the present invention, a wiring connecting system having an improved wire strip, connecting block, and cross-talk barrier is disclosed. The wiring connecting system includes a base, a wire strip mountable to the base, a connecting block for housing a plurality of electrical contacts and a plurality of cross talk barriers disposed within the connecting block for isolating pairs of the electrical contacts.

The wire strip has a plurality of first and second posts alternating along its length. The second posts have a greater width than the first posts. The first posts and second posts define an opening to receive a wire therebetween. A connecting block for housing a plurality of electrical contacts mounts onto the wire strip. The connecting block is made of an insulative material and includes opposed sidewalls and opposed upper and lower ends. The upper end includes a plurality of first and second teeth alternating along its length. The second teeth have a greater width than the first teeth. A space is provided between the teeth to receive a wire. The electrical contacts are partially disposed within the space and extend from the lower end of the connecting block to generally align with the openings of the wire strip. A plurality of barriers for electrically shielding pairs of the electrical contacts are disposed within the connecting block housing and substantially surround respective pairs of the electrical contacts.

In a preferred embodiment, the barriers include depending legs which seat within the second posts of the wire strip. The barriers may also include extending arms which nestle within the second teeth of the connecting block.

A plug for connecting a cable having a plurality of wires to the connecting block is also disclosed in accordance with the present invention. The plug includes a housing having a first end, a second end and a hollow interior. The first end has a hole to receive the cable and the second end has a plurality of openings which are generally aligned with the spaces between the first and second teeth of the connecting block so that the electrical connectors disposed within the housing interior can electrically connect to the electrical contacts housed within the connecting block when the plug is mounted to the connecting block. In another embodiment the electrical connectors are either J shaped or C shaped to reduce transmission loss within pairs of the electrical connectors. A shield may be disposed on a side of the plug to alter the magnetic fields associated with the wire contact pairs to further reduce cross-talk.

DETAILED DESCRIPTION OF THE DRAWINGS

Figure 1:
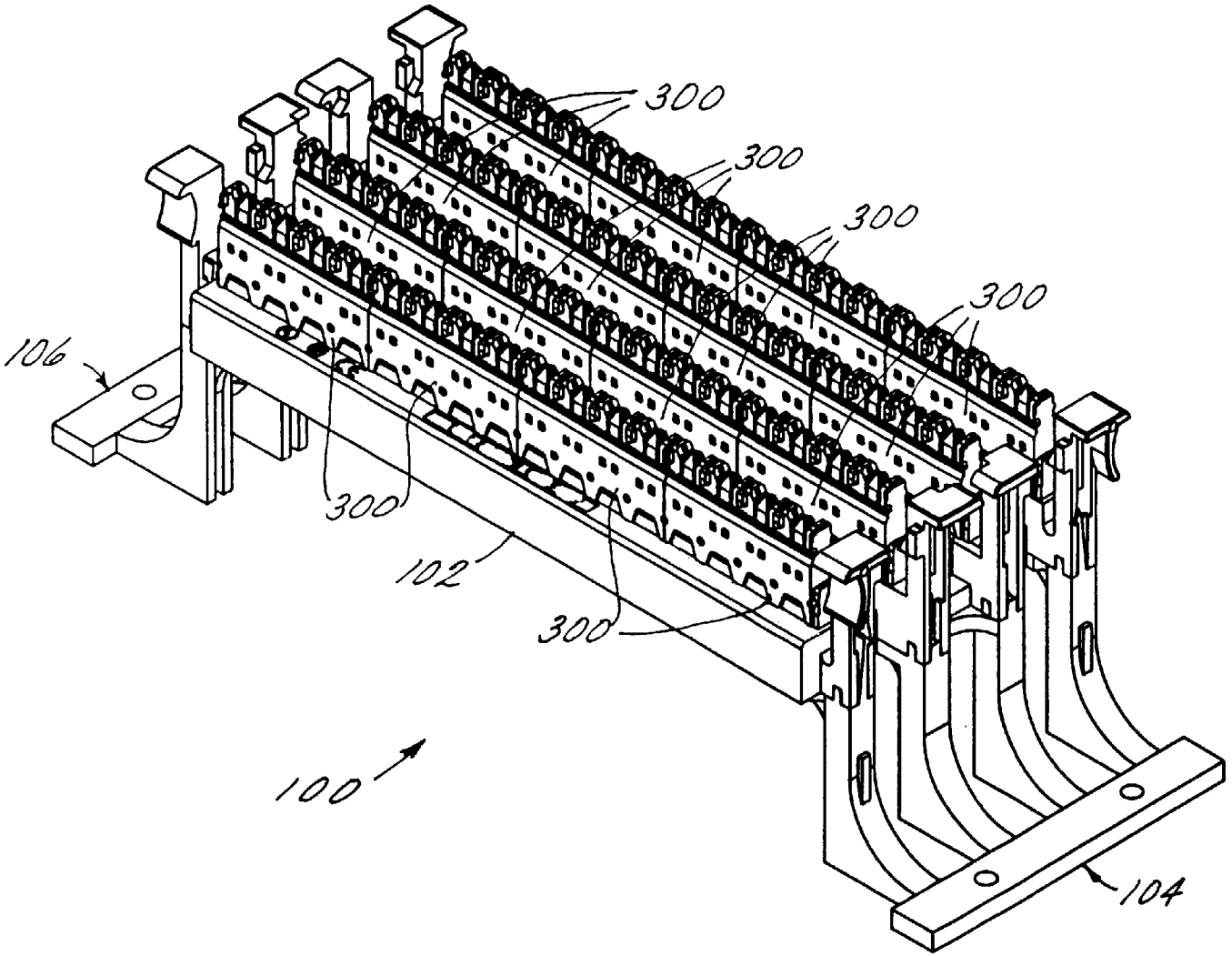
FIG. 1 is a perspective view of a wiring connecting system in accordance with the present invention.
Figure 2:
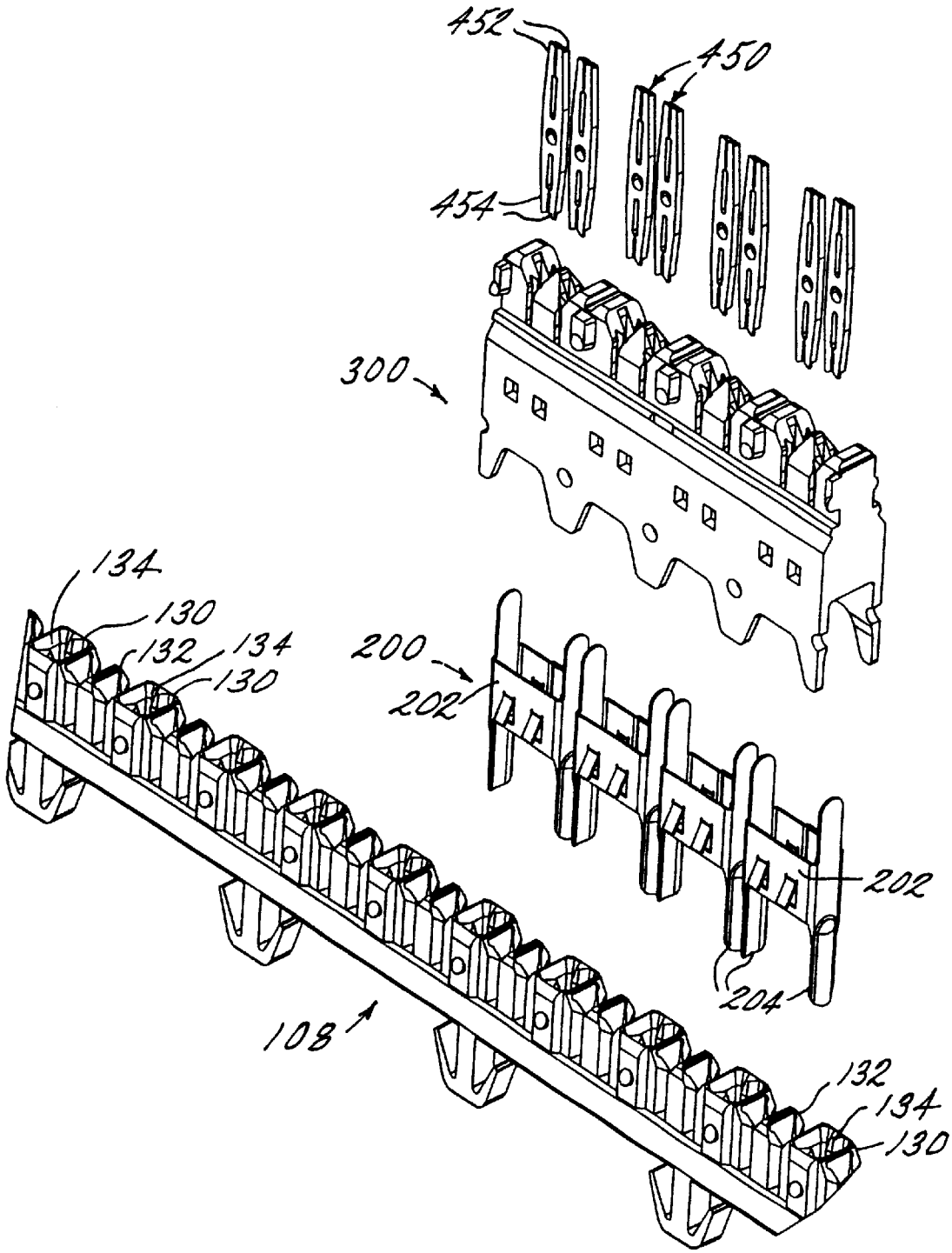
FIG. 2 is an exploded assembly view of a connecting block, a wire contact, a cross talk barrier and a wire strip, for use in the wiring connecting system of FIG. 1 in accordance with the present invention.
Figure 3:
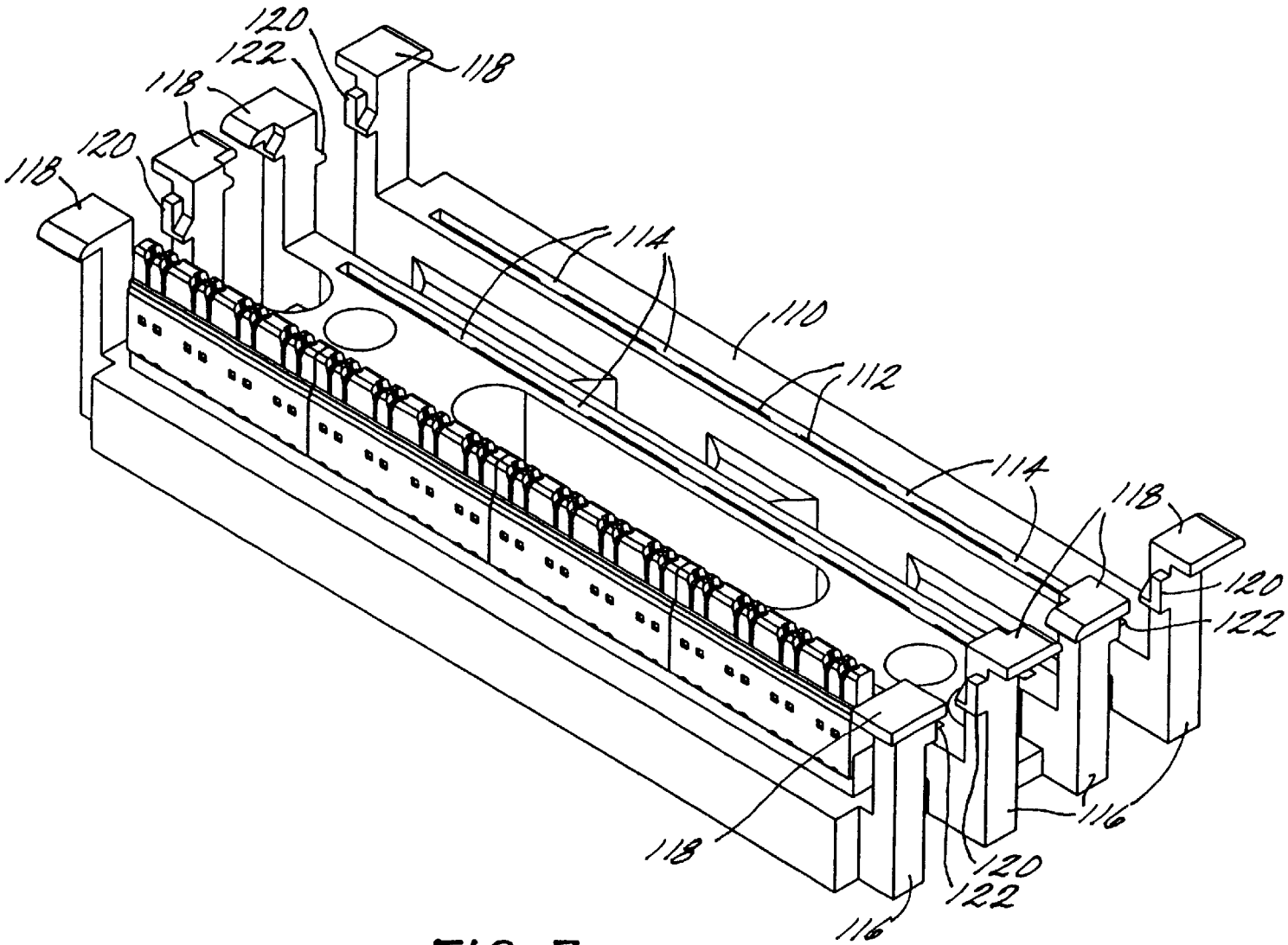
FIG. 3 is a perspective view of the connector blocks mounted to a base of the wiring connecting system of FIG. 1.

Referring now to FIGS. 1 through 3, a wiring connecting system in accordance with a preferred embodiment of the invention is generally shown at 100. Wiring connecting system includes base 102 having a first leg assembly 104 and a second leg assembly 106 at its ends. Wire strips 108 are mounted to the upper surface 110 of base 102. Upper surface 110 of base 102 has U-shaped channels 112, each having a plurality of rectangular openings 114. Upright members 116 extend upward from base 102 and terminate in flat surfaces 118. Latching protrusions 120 and 122 engage respective leg assemblies 104 and 106 to allow the leg assemblies to be removably attached as described in more detail in U.S. Pat. No. , Re. 35,030, incorporated herein by reference.

Wire strips 108 include posts 124 having a pair of resilient arms 126 extending therefrom. Posts 124 depend from longitudinal rail 128 of wire strip 108 and are inserted into rectangular openings 114 to secure wire strip 108 to base 102. Resilient arms 126 are compressed and then return to their original position after posts 124 are inserted into openings 114. Wire strip 108 includes a plurality upwardly extending posts in the form of divider post 130 and middle post 132 which are disposed between respective divider posts 130. Divider posts 130 have a subdivided opening 134. As described in more detail below, wires terminated at wiring block 100 are disposed on each side of a respective middle post 132 to form a wire pair. Divider posts 130 have a greater width than middle posts 132 so that there is greater separation between respective wire pairs than between the wires which form the pair. Cross talk barriers 200 include a generally hollow rectangular body 202 with lower depending legs 204 and upwardly extending arms 206. Barrier 200 is made of an electrically conductive material with suitable shielding properties. Preferably, barriers 200 are made of metal. Legs 204 insert into respective subdivided openings 134 of divider posts 130 so that respective bodies 202 of barriers 200 surround the area extending above respective middle posts 132.

Connector blocks 300 have a generally insulative body 302 and mount on to wiring strip 108. Barrier bodies 202 are disposed within connector block 300 when connector block 300 is mounted to wire strip 108. Connector block 300 includes center teeth 304 and barrier teeth 306 with a channel slot 308 therebetween. Wire contacts 450 are disposed in respective channel slots 308 between center teeth 304 and barrier teeth 306. Wire contacts are preferable insulation displacement contacts such as those described in U.S. Pat. No. 4,964,812 incorporated herein by reference. Wires terminated at wiring block 100 are connected at connector block 300 by press fit into wire contacts 450. Each wire of a wire pair is disposed on one side of a respective center tooth 304. As described in more detail below, barrier teeth 306 have a greater width than center teeth 304 so that there is greater separation between respective wire pairs than between the wires which form the pair. Each connector block 300 includes depending sides 310 which receive wiring strip 108 therebetween. Arms 206 of barriers 200 extend into respective barrier teeth 306 when connector blocks 300 are mounted to respective wiring strips 108 so that wire contacts 450 are essentially surrounded within respective barrier bodies 202. Thus in use, wire contacts 450 are surrounded by cross talk barriers 200 to reduce cross talk between wire pairs.

Figure 4:
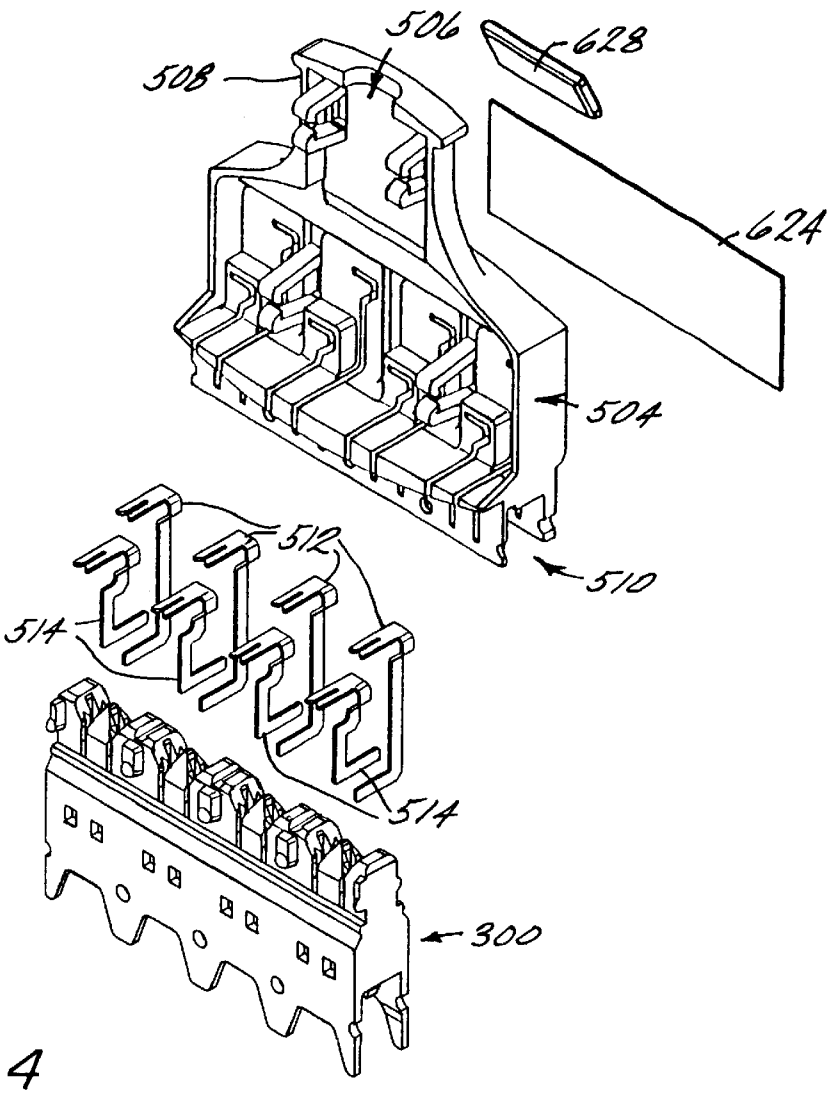
FIG. 4 is an assembly view of a plug in accordance with the present invention positioned over the connecting block of FIG. 2.
Figure 4:
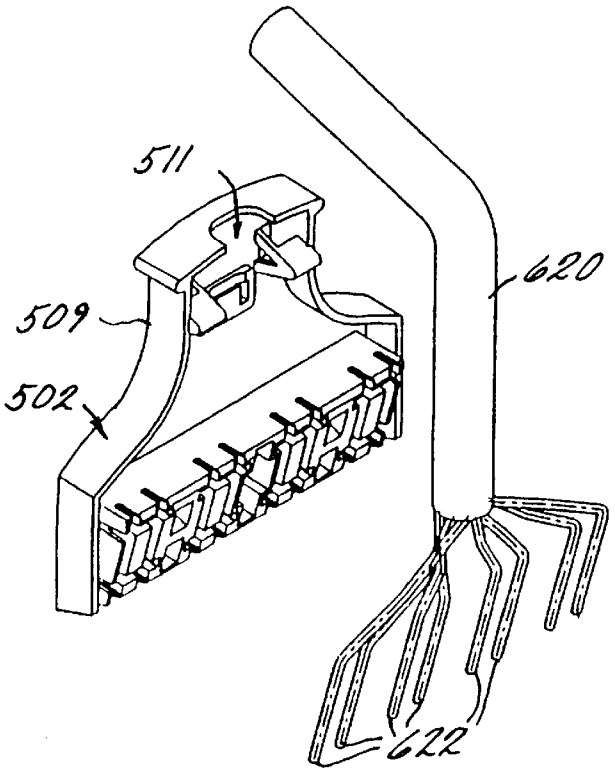
Figure 5:
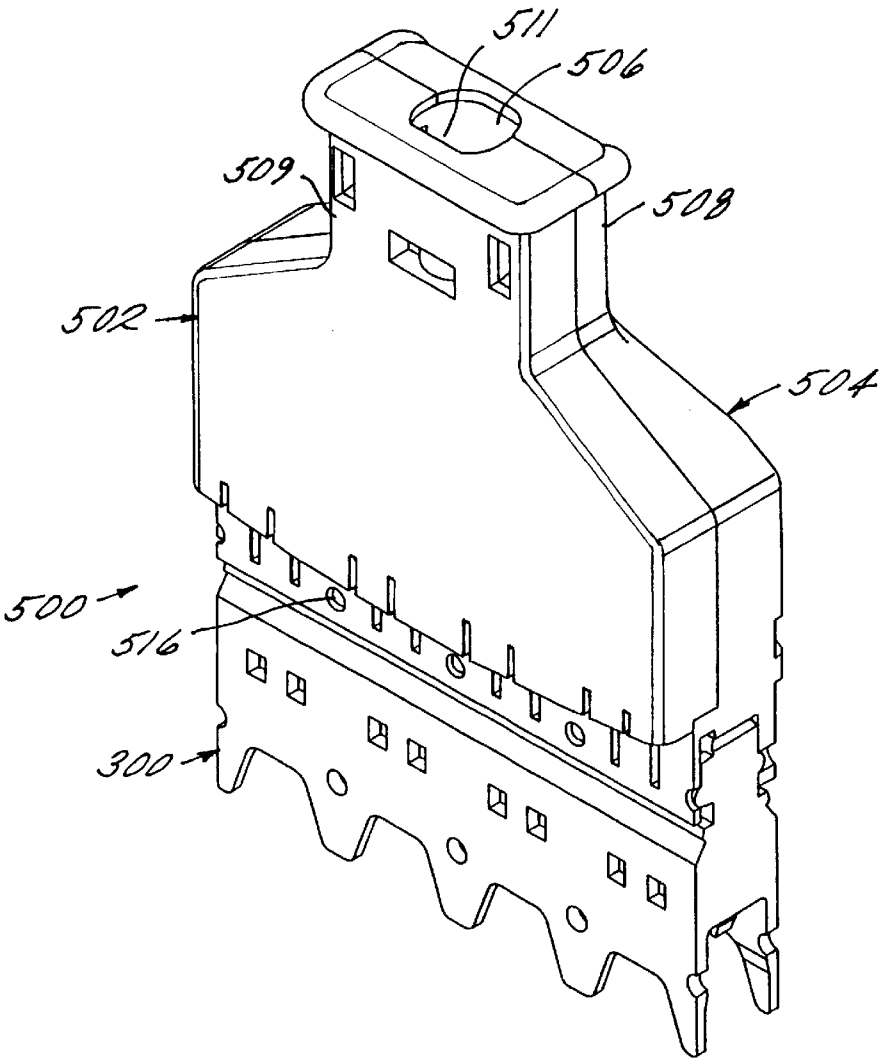
FIG. 5 is a perspective view of the plug of FIG. 4.

Referring now to FIGS. 4 and 5, an interface plug for use with wiring connecting system 100 in accordance with the present invention is generally shown at 500. Plug 500 includes a generally insulative hollow body comprising first and second housing portions 502 and 504 with respective openings 506 and 511 in handle portions 508 and 509 to receive a cable 620 of wires 622. Plug 500 includes U-shaped plug end 510. Disposed within plug 500 are first and second contacts 512 and 514. Contacts 512 and 514 extend from plug 500 at plug end 510 and are spaced in pairs to mate with respective contacts 450 disposed on each side of a respective center tooth 304 of a connector block 300. A cable of wires is disposed through openings 506 and 511 and each wire is electrically connected to respective contacts 512 and 514 in wire pairs. As described in more detail below, the geometries of the respective contacts 512 and 514 provide for reduced cross talk within each pair by reducing the proximity of the contacts with respect to each other. In use contacts 512 and 514 make electrical contact with wire contacts 450 when plug 500 is mounted to connector block 300 on wiring block 100. Plug also includes shield 624 to contain magnetic fields generated by contacts 512 and 514. Icon 628 allows a user to identify the plug 500.

Figure 6:
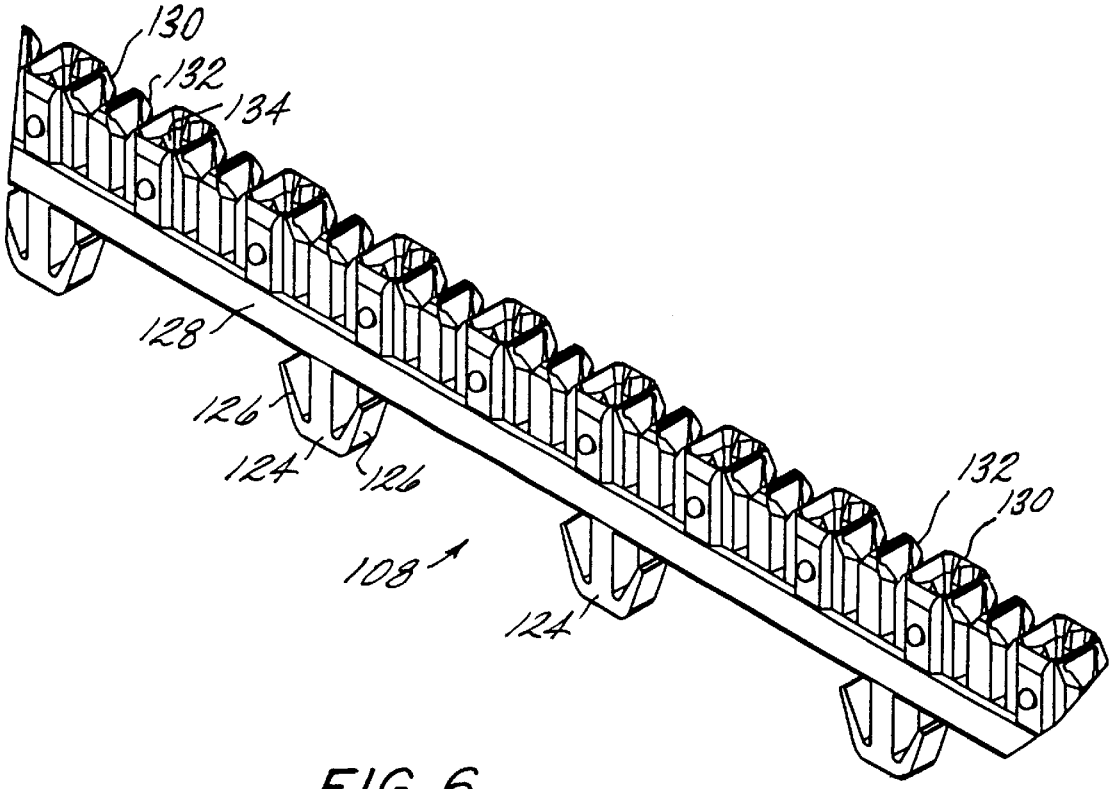
FIG. 6 is a perspective view of a wire strip for use in the wiring connecting system of FIG. 1 in accordance with the present invention.
Figure 7:
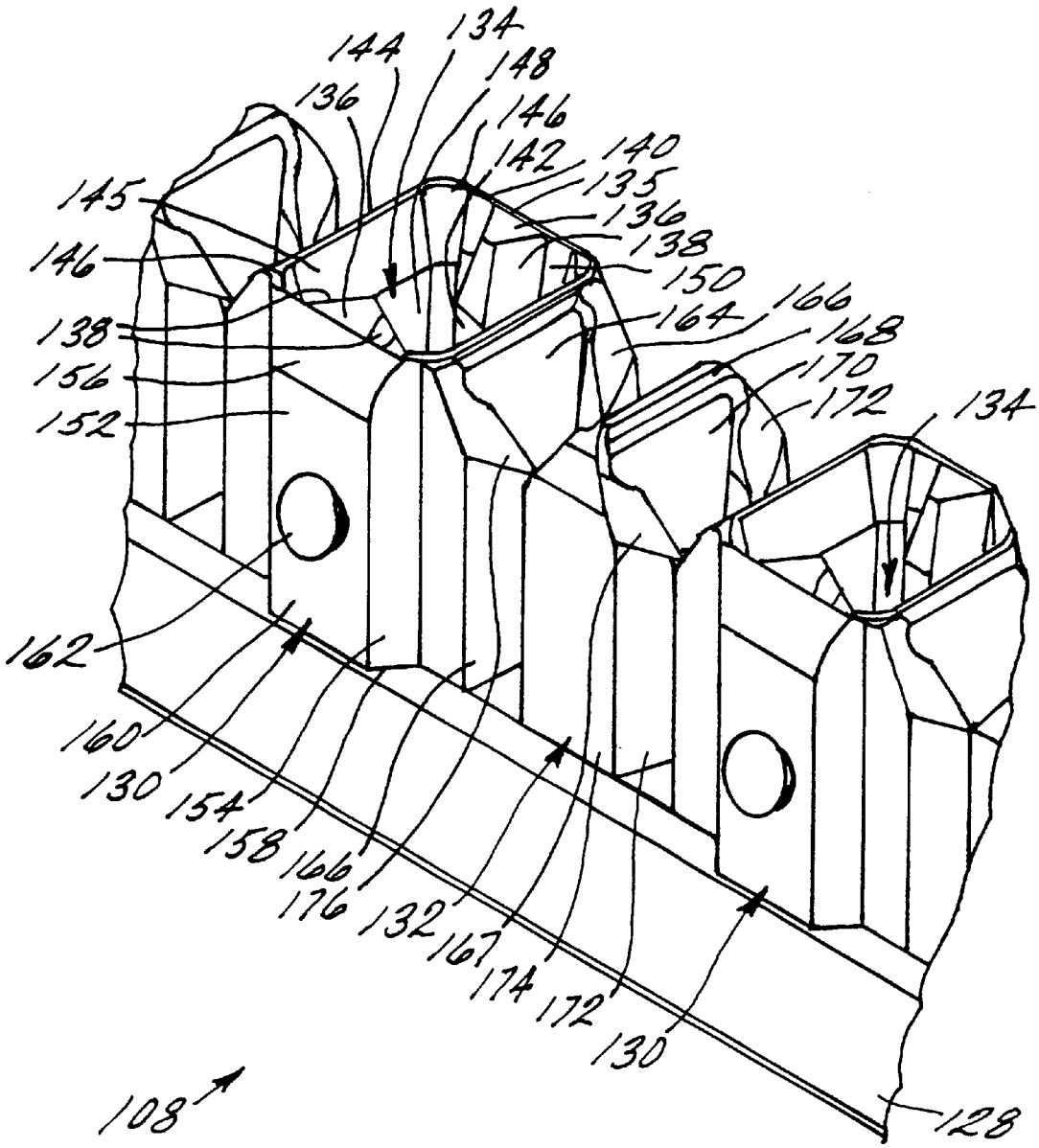
FIG. 7 is a perspective view of the posts of the wiring strip of FIG. 6.

Referring now to FIGS. 6 and 7, a detailed discussion of wire strip 108 follows. Wire strip 108 includes a longitudinal rail 128 having a plurality of divider posts 130 and middle posts 132 extending upward therefrom and is made of an insulative material, preferably plastic, such as polycarbonate. Each divider post 130 is generally rectangular with a subdivided opening 134 at its top 135. Wall protrusions 136 are disposed on the interior surface 150 of each sidewall 152. Wall protrusions 136 have side angled surfaces 138 which join a top angled surface 140 at the top 135 of divider post 130. Angled surfaces 138 and 140 extend down to the generally rectangular wall protrusion body 142. Sidewalls 152 and end walls 144 join at rounded comers 146. In this manner, depending legs 204 of adjacent cross talk barriers 200 are received within opening 134 and retained in spaced apart arrangement by the wall protrusions 136. Each side wall 152 has a top angled surface 156, side angled surfaces 154 and a bottom angled surface 158 which extend outward and join at external sidewall surface 160. Cylindrical protrusions 162 extend outward from external side wall surfaces 160 (on both sidewalls). As shown in FIG. 2, connector block 300 has a plurality of openings 312 in which cylindrical protrusions 162 nestle to allow connector block 300 to removably attach to wire strip 108, preferably by snap fit. Each end wall 144 has an angled top wall surface 145, an interior wall surface 148 and an exterior wall surface 164. Projecting wall portions 166 extend outward from external wall surface 164 at an acute angle. Each middle post 132 has an I-shaped top portion 168. Extending from each end wall 170 are projecting wall portions 172 which project inward at an acute angle. Each middle post 132 includes opposed side walls 174. Wires to be terminated at wire strip 108 are disposed on each side of a respective middle post 132 to form a wire pair. Wires are retained between projecting respective wall portions 166 of divider posts 130 and respective projecting walls 172 of middle posts 132. Projecting wall portions 166 and 172 have respective angle surfaces 167 and 176. Locking nubs (not shown) may be disposed on either of the projecting walls 166 and 172 to additionally assist retention of wires between respective projecting walls 166 and 172.

Figure 8:
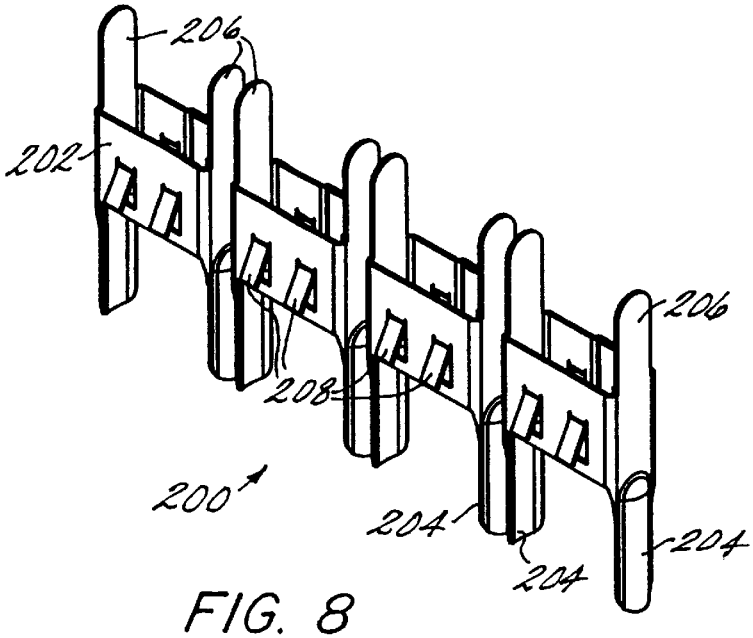
FIG. 8 is a perspective view of a cross talk barrier in accordance with the present invention.

Referring to FIG. 8, cross talk barriers 200 are made of a conductive material with suitable shielding characteristics, preferably metal, and comprise rectangular body portions 202 having depending legs 204 and extending arms 206. Legs 204 and arms 206 are preferably flat. Tabs 208 disposed on side walls 210 extend outward and engage rectangular openings 314 of connector block 300 when cross talk barrier is disposed within connector block 300. In this manner barriers 200 are retained within connector block 300. Legs 204 insert into respective subdivided openings 134 of divider posts 130 so that respective bodies 202 of barriers 200 surround the area extending above respective middle posts 132. Arms 206 of barriers 200 extend into respective barrier teeth 306 when connector blocks 300 are mounted to respective wiring strips 108 so that wire contacts 450 are essentially surrounded within respective barrier bodies 202.

Referring to FIGS. 9 and 10*a*–10*e*, a detailed discussion of connecting block 300 follows. Connector block 300 includes a generally hollow rectangular insulative body 302 (preferably made of polycarbonate) having a plurality of center teeth 304 and barrier teeth 306 (with channel slots 308 therebetween) running the length of its upper surface 309. Center teeth 304 and barrier teeth 306 are also generally rectangular and hollow. Barrier teeth 306 have a greater width than center teeth 304. Teeth 304 and 306 stagger in width so that respective wire pairs (disposed on each side of the center teeth 304) are separated by barrier teeth 306 having a greater width than the center teeth 304. Depending sides 310 extend from the lower U-shaped channel 316 disposed at bottom 318 of connector block 300. Each barrier tooth 306 has a center slot 320 and a retaining protrusion 322 with a circular extension 324 extending from front outer side wall 326. Circular extensions 324 engage openings 516 of plug 500 (see FIG. 5) to provide a defeatable attachment. Inner wall 328 includes circular extensions 330. Barrier teeth 306 include upper surface 332, front angled surface 334, rear angled surface 336 and side angled surfaces 338. Slots 340 are formed in barrier teeth end walls 342. Center teeth 304 include top surface 344, front angled surface 346, rear angled surface 348 and side angle surfaces 350. Slots 352 in center teeth end walls 354 and slots 340 in barrier teeth end walls 342 form wire contact retaining channel slots 356 where wire contacts 450 are retained. Spaces 308 between center teeth 304 and barrier teeth 306 allow wires to be disposed between center teeth 304 and barrier teeth 306 and inserted in wire contacts 450. Sides 310 include lower portions 358. Sides 310 are rounded 360 at the junction of sides 310 and bottom end wall 362. Inner protrusions 364 allow sides 310 to defeatably attach connector block 300 onto wiring strip 108. Front body wall 368 and rear body wall 370 have respective angled surfaces 372 and 374 adjacent protrusions 376 and 378. Arms 206 of cross talk barrier 200 are seated within respective barrier teeth 306 so that body 202 of cross talk barrier 200 generally surrounds the center portions of the wire contacts 450 when block 300 is mounted to wire strip 108. Tabs 208 of cross talk barrier 200 seat within rectangular openings 314 of body 302 to reduce cross talk barrier 200 within connector block 300 when assembled.

Figure 9:
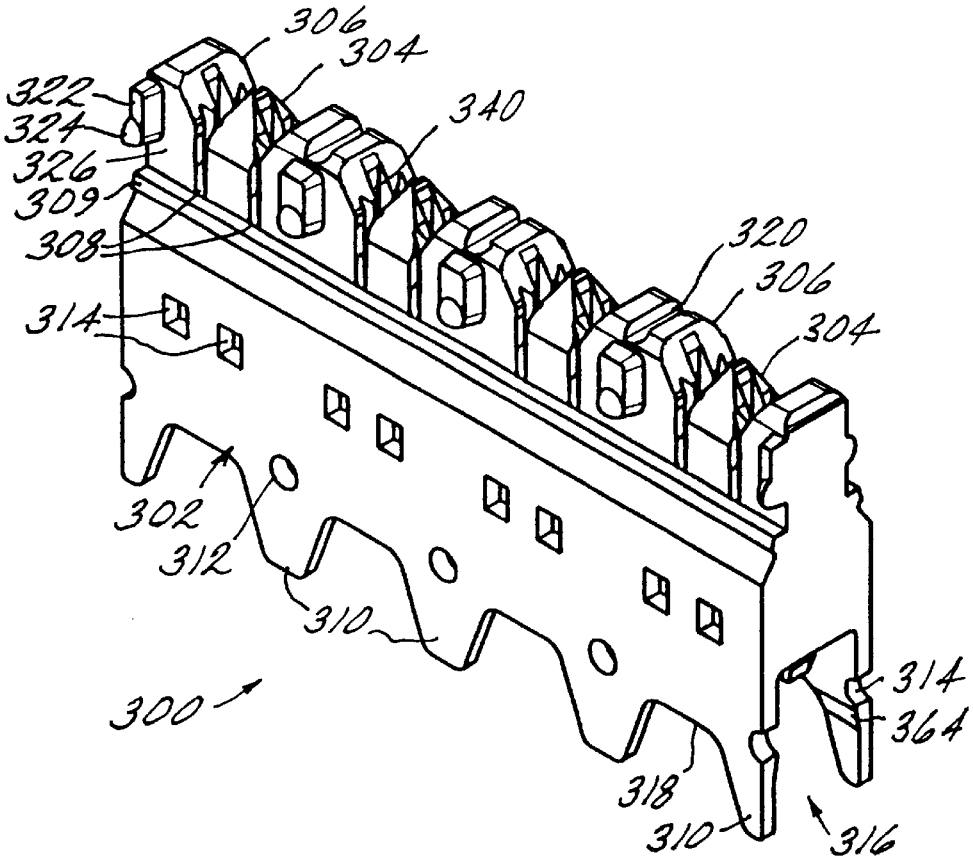
FIG. 9 is a perspective view of a connecting block in accordance with the present invention.
Figure 10B:
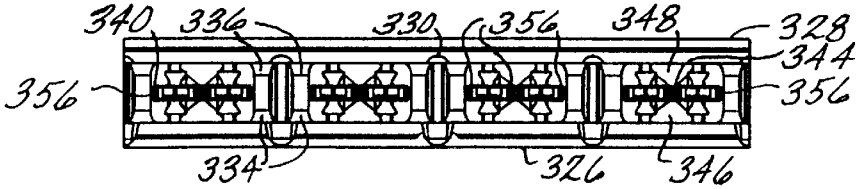
FIG. 10*b* is a top view of a connector block having cross talk barriers and wire contacts assembled therein in accordance with the present invention.
Figure 10A:
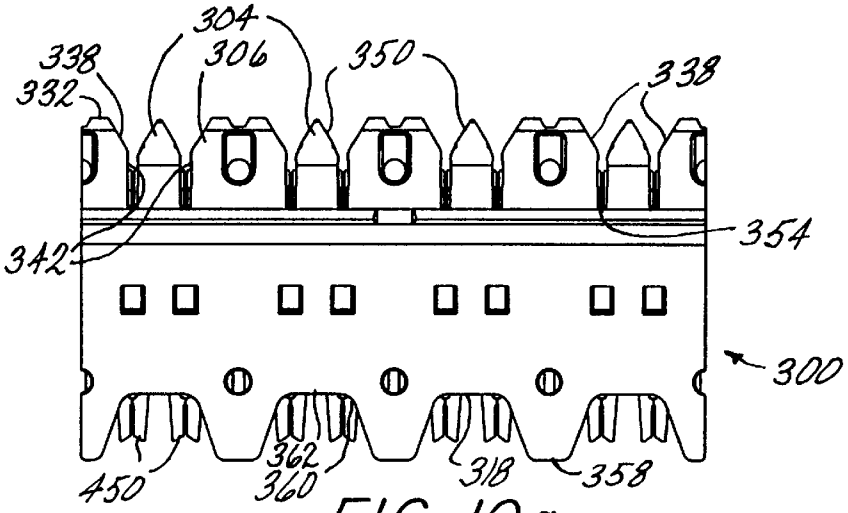
FIG. 10*a* is a front view of a connector block having cross talk barriers and wire contacts assembled therein in accordance with the present invention.
Figure 10E:
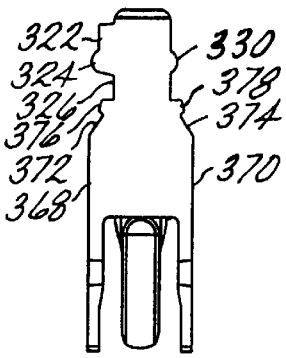
FIG. 10*e* is a right side view of a connector block having cross talk barriers and wire contacts assembled therein in accordance with the present invention.
Figure 10D:
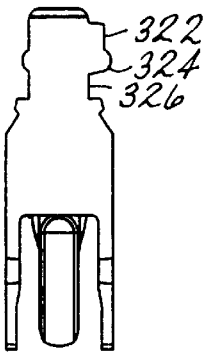
FIG. 10*d* is a left side view of a connector block having cross talk barriers and wire contacts assembled therein in accordance with the present invention.
Figure 10C:
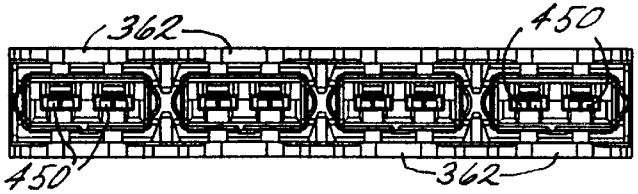
FIG. 10*c* is a bottom view of a connector block having cross talk barriers and wire contacts assembled therein in accordance with the present invention.

As also shown in FIG. 9, retaining protrusions 322 with a circular extensions 324 extend only from respective front outer side walls 326. This feature allows mating connectors, such as plug 500, or adapters to be polarity sensitive and to engage connector block 300 in one orientation to prevent connection when a connector is not properly orientated with respect to polarity. See discussion below.

Referring again to FIGS. 1 and 2, in use, a user may mount wiring block 100 on a flat surface, such as a wall, and terminate backbone or horizontal cabling to the wire strip 108 by pressing each wire between respective divider posts 130 and middle posts 132. Legs 204 of cross talk barriers 200 are seated in subdivided openings 134 of divider posts 130 so that respective bodies 202 of cross talk barriers 200 are disposed above middle posts 132. Thus, wire contacts 450, when inserted into slots 356 of connector block 300 are essentially centered within cross talk barriers 200 in pairs when connector block 300 is mounted to wire strip 108. In this manner, wire pairs connected to wire contact 450 pairs have shielding essentially on all sides. Moreover, the greater width of divider posts 130 reduces cross talk by increasing the space between respective wire pairs. It will be appreciated by those skilled in the art from reading this discussion that the precise geometries of the cross talk barrier 200 may be varied so long as the wire pairs and associated wire contacts 450 are essentially surrounded on all sides when connector block 300 is mounted to wire strip 108 and greater distance is provided between pairs.

Figure 11:
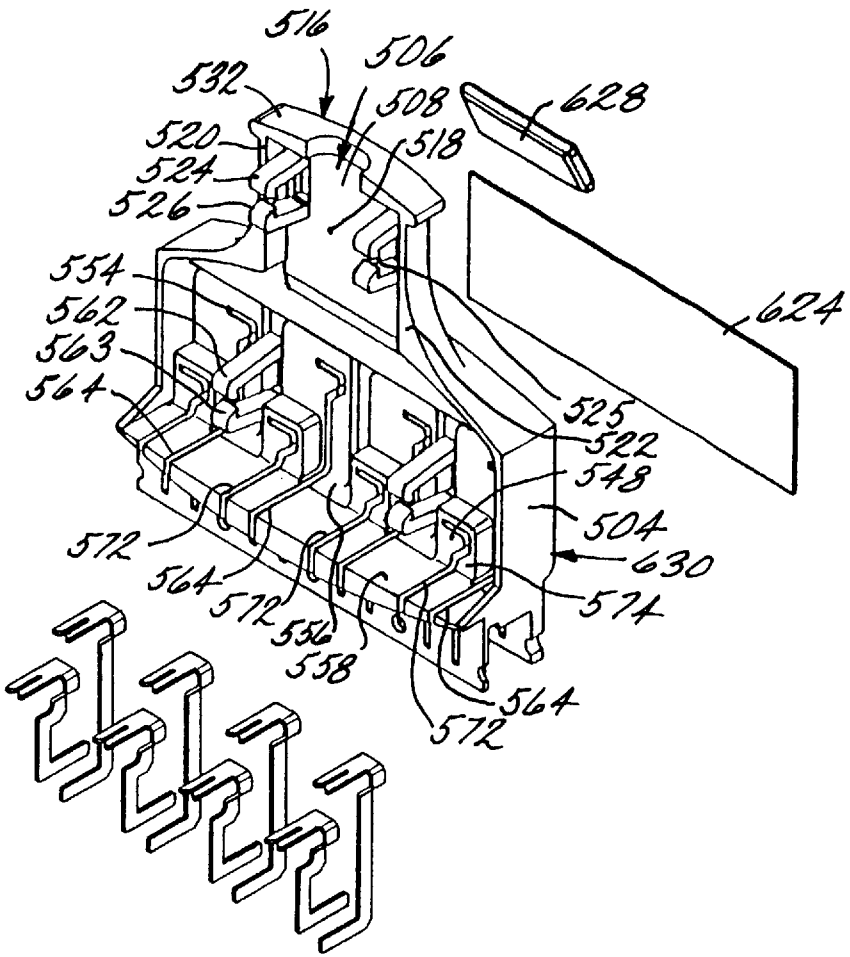
FIG. 11 is an exploded assembly view of the plug for use with the connecting block.
Figure 11:
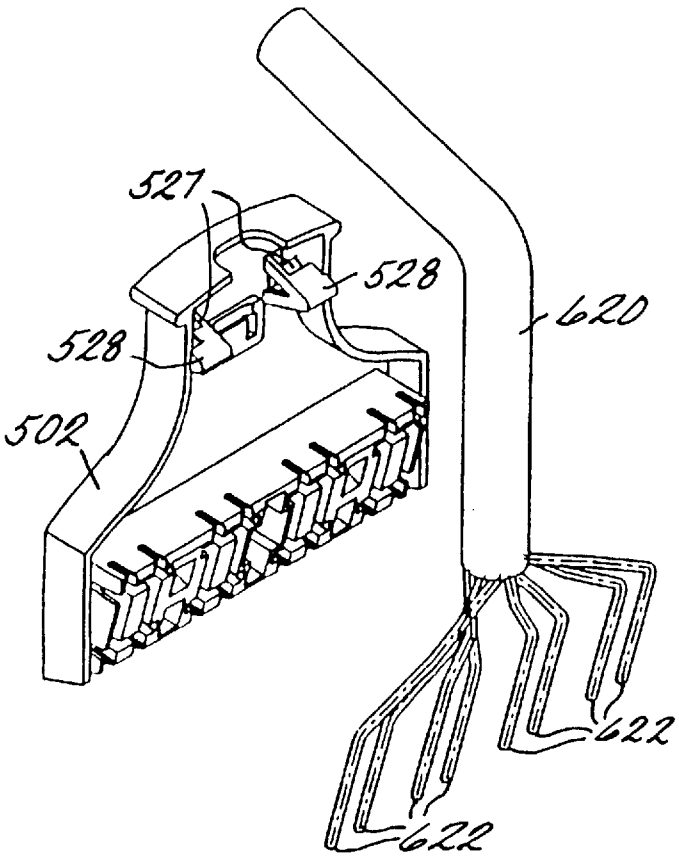
Figure 12:
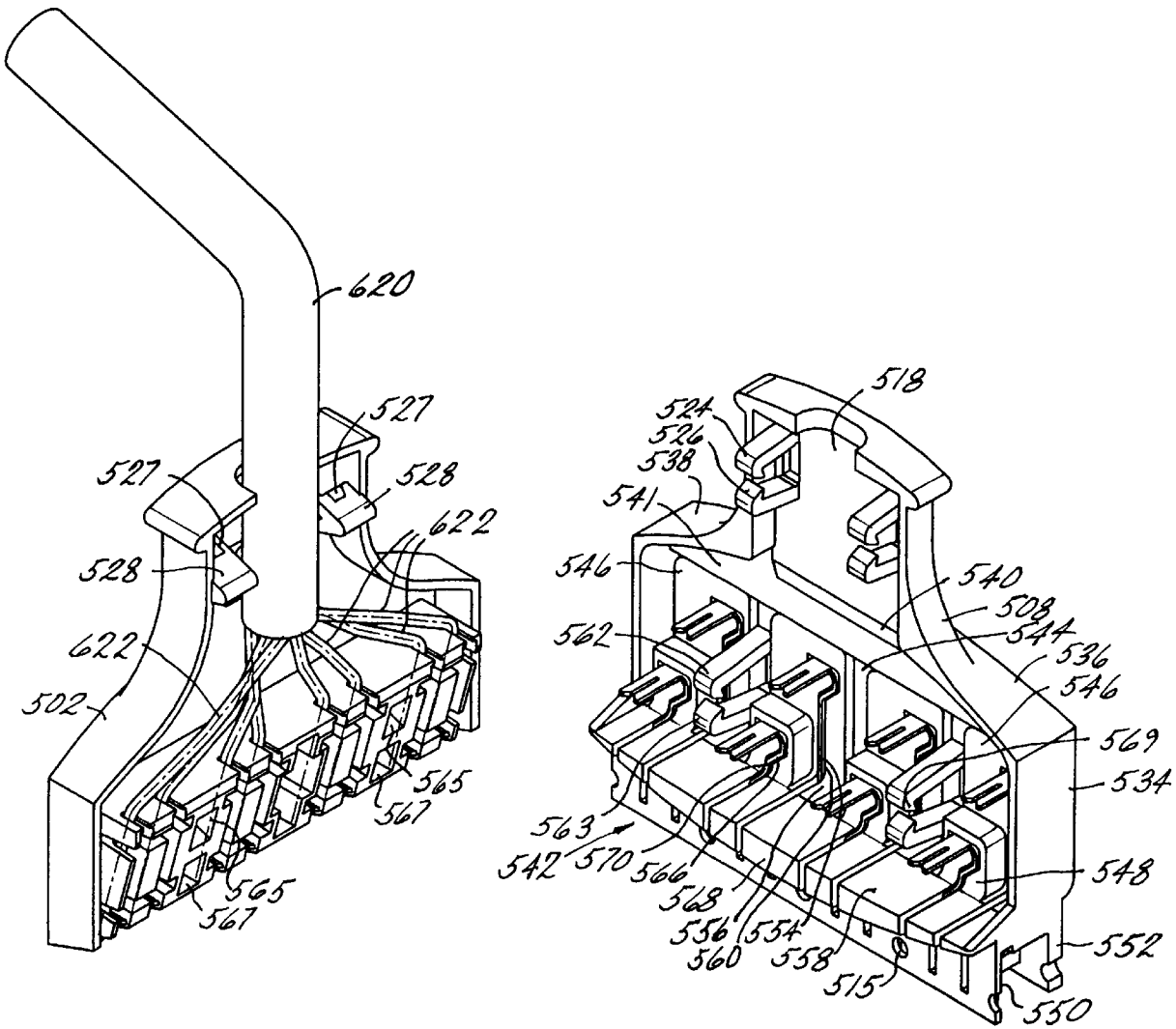
FIG. 12 is an exploded assembly view of the plug.
Figure 13E:
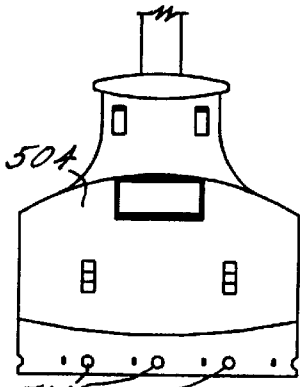
FIG. 13*e* is a back view of the plug.
Figure 13D:
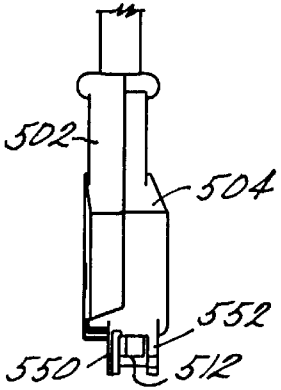
FIG. 13*d* is a right side view of the plug.
Figure 13B:
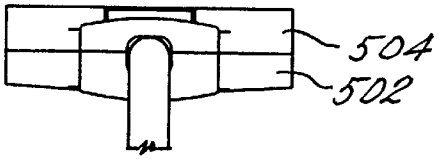
FIG. 13*b* is a top view of the plug.
Figure 13A:
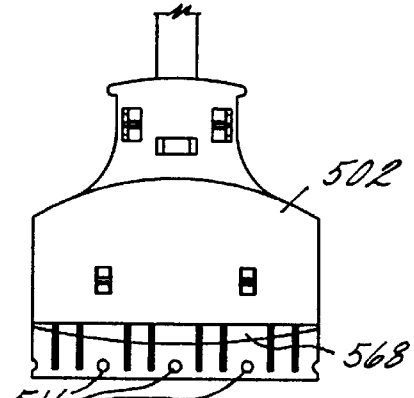
FIG. 13*a* is a front view of the plug.
Figure 13C:
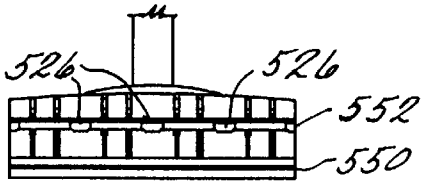
FIG. 13*c* is a bottom view of the plug.
Figure 13F:
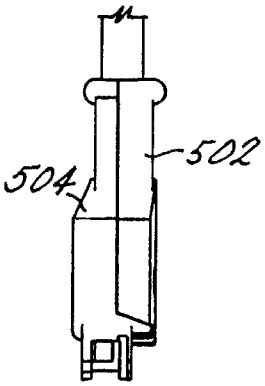
FIG. 13*f* is a left side view of the plug.

Turning now to FIGS. 11 and 12, plug 500 comprises two housings 502 and 504 of a generally insulative material, such as plastic. Housing 504 has a handle portion 508. Handle portion 508 of housing 504 includes handle outer and inner surfaces 516 and 518, handle end walls 520 and 522, a pair of resilient locking arms 524 and 526, and handle top wall 532. Resilient arms 524 and 526 have locking nubs 525 and receive locking protrusions 528 of housing 502 between respective arms 524 and 526. Locking nubs 525 are nestled within openings 527 to provide a secure attachment of respective housings 502 and 504. Handle 508 of housing 504 tapers to a main body portion 534 at connecting walls 536 and 538. Inner surface 518 extends downward to edge 540 of intermediate portion 541 which forms the top of contact retention cavity 542 in main body portion 534. Contact retention cavity 542 includes inner wall surface 544, first contact retention surface 546 and second contact retention surface 548 which terminate at legs 550 and 552. Contact retention surface 546 is disposed on inner wall surface 544 and has contoured slots 554 which retain contacts 512. Contact retention surface 546 includes a rounding portion 556 which joins lower wall 558 of contact retention cavity 542. Contoured slots 554 have vertical portions 560 and terminate in lower wall slots 564. A second pair of resilient arms 562 and 563 are disposed within cavity 542 and seat within a pair of respective openings 565 and 567 of housing 502 to hold the housings 502 and 504 together. Locking nubs 569 provide a latching feature. Second contact retention surface 548 is raised from first contact retention surface 546 and has shorter contoured slots 566 having vertical portions 570 which terminate in lower wall slots 572 of lower wall 558. Second contact retention surface 548 also includes a rounded portion 574 as it joins lower wall 558. As shown in FIGS. 13*a*–13*f*, and described in more detail below, when contacts 512 and 514 are disposed into respective contoured slots 554 and 566, contacts 512 and 514 sufficiently protrude from lower wall 558 of housing 504 so that they may be electrically connected, such as by insertion to wire contacts 450 disposed in connector block 300. Rounded projecting portion 568 extends outward from leg 550 and covers the wire ends when housings 502 and 504 are assembled.

Figure 14:
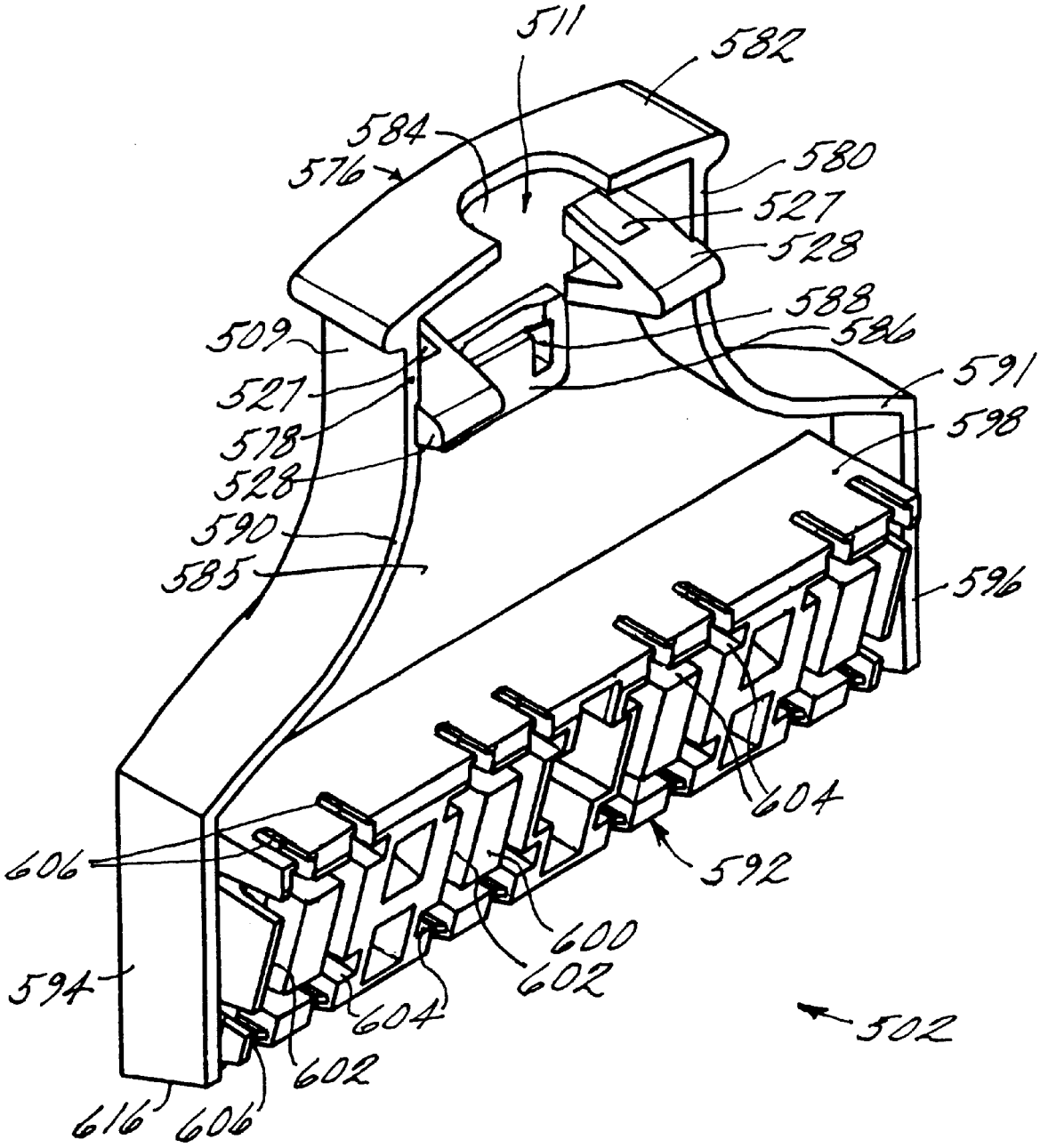
FIG. 14 is a perspective view of one of two housing halves of the plug of FIG. 12.

Referring now to FIG. 14, housing 502 includes handle portion 509 having an opening 511, exterior wall surface 576, end walls 578 and 580, top wall 582 and side wall 584. Cable retention surface 586 is raised from inner wall surface 585 and has rectangular openings 588 for receiving a cable strap (not shown) to retain a wire cable. Protrusions 528 protrude from inner wall surface 585 and lodge between locking arms 524 and 526 when housing 502 and 504 are attached to each other and serve to defeatably attach housings 502 and 504. Protrusions 528 have openings 527 to receive locking nubs 525 on each side. Handle ends walls 578 and 580 join taper wall portions 590 and 591 which in turn join plug end walls 594 and 596 to contain contact retention block 592. Contact retention block 592 has an upper surface 598, a taper side wall 600 and a plurality of contact retention slots 602 and 604 and is attached to inner surface 585. Contact retention slots 602 are vertically aligned and parallel with respect to each other. Contact retention slots 604 are horizontal and parallel and positioned in crosswise fashion to contact retention slots 602. Contact retention slots 602 have nubs 606 facing each other at both ends of retention block 592 to retain respective wires placed into slots 602. In this manner assembly is easily facilitated as wires are laced in slots 602 and terminated by respective contacts 512 and 514 when housings 502 and 504 are assembled.

Referring again to FIGS. 13*a* through 13*f*, polarity slots 526 are disposed on leg 550 at plug end 510 to receive respective extensions 322. Cylindrical protrusions 324 (shown in FIG. 9) are seated in holes 516. Leg 552 does not have polarity slots 526 so plug 500 can only mount onto block 300 in one direction which achieves polarity.

Figure 15:
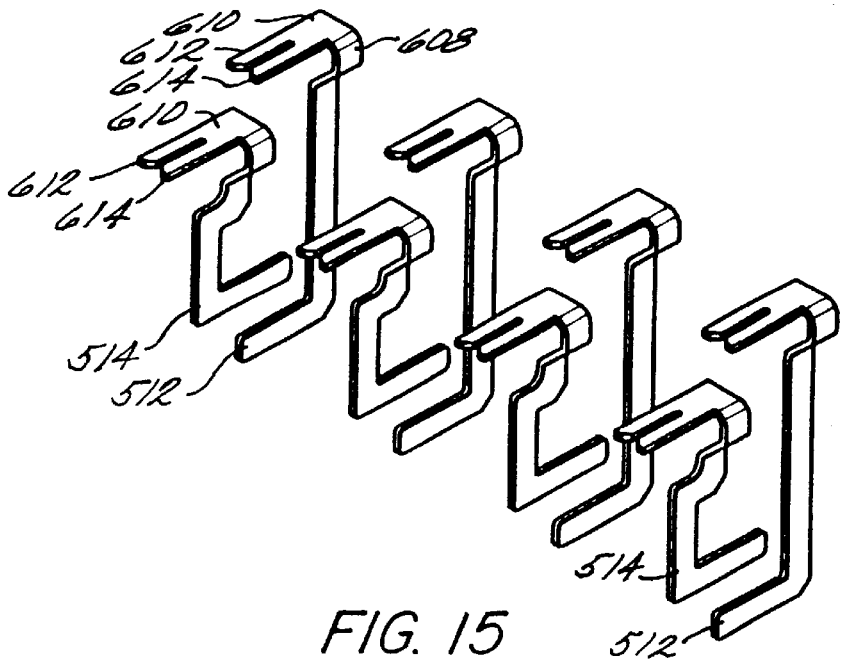
FIG. 15 is a perspective view of contacts used in the plug in accordance with the present invention.

As shown in FIG. 15, contact 512 comprises an elongated J shaped plate member having a curved-shaped portion 608 disposed at its top. A wire retention clip 610 is connected to curved-shaped portion 608 having forcations 612 and 614. Contact 514 comprises a C-shaped plate member having an elbow connected to its curved-shaped portion 608 also having wire retention clip 610 with forcations 612 and 614. Wires to be terminated within plug 500 are laced in slots 602 and are terminated between forcations 612 and 614 when housings 502 and 504 are assembled. When housings 502 and 504 are assembled, wire clips 610 nestle into respective slots 604 when housing 502 is mounted to housing 504. Housing 502 further includes angled end portion 616 in end wall 594 which receives lower wall 558 of housing 504.

Thus in use, plug 500 is assembled by inserting contacts 512 and 514 into respective contoured slots 554 and 566 so as to protrude from lower wall surface 558 of housing 504. A cable 620 having wires 622 is terminated by lacing respective wires 622 in respective slots 602 and then into wire clips 610 of contacts 512 and 514 by insertion between forcations 612 and 614 when housings 502 and 504 are fitted together, thus decreasing assembly time and facilitating ease of use. The wires 622 are clipped along angled end portion 616 so that the wire ends are covered by rounded projecting portion 568 to provide a neat appearance. Openings 506 and 511 allows cable to exit plug 500. A cable strap may be inserted in rectangular openings 588 to secure the wire cable so that in use stress is not applied to contacts 512 and 514. Housing 502 is mounted to housing 504 so that resilient arms 524 and 526 receive protrusions 528 therebetween and resilient arms 562 and 563 are received in openings 565 and 567. Clips 610 nestle in slots 604 when housings 502 and 504 are attached. Contacts 512 and 514 are spaced apart in pairs. Each pair of contacts 512 and 514 are spaced for conventional 110 type wire spacing, however, the space between respective pairs is greater to allow for better reduction of cross talk between pairs. Further, the contour of contacts 512 and 514 in the respective J-shape and C-shape reduces the area of overlap within pair of contacts which enhances cross talk reduction between pairs. The upper portion of C-shaped contact 514 is shorter than its base to further reduce overlap (and thus cross talk is reduced between pairs). The position of slots 564 and 566 in housing 504 allows for greater insulative material (plastic) to surround each respective contacts 512 and 514 to maximize the distance between adjacent contacts within two pairs resulting in a reduction in cross talk involving the pairs. Plug 500 removably attaches to connector block 300 by the insertion of the exposed portions of contacts 512 and 514 into wire clips 450. Cylindrical protrusions 324 nestle within holes 516 to allow plug 500 to defeatably lock on to connector block 300. Plug end walls 550 and 552 are preferably resilient and receive teeth 304 and 306 therebetween. It will be apparent to those of ordinary skill in the art based on this disclosure that the number of wire pairs may be varied (e.g., 2 pair, 3 pair, 4 pair, etc.).

Referring again to FIG. 11, plug 500 may also include an electrically conductive shield 624 and an icon 628 disposed on housing back 630 of housing 504. Shield 624 further reduces cross talk by providing isolation from varying magnetic fields between pairs produced by RF currents traveling within contacts of a pair. Shield 624 also provides isolation from varying magnetic fields between pairs which results in enhanced cross talk reduction between these pairs. Shield 624 is preferably made of metal. Icon 628 allows a user to mark plug 500 for identification, e.g. computer, telephone, etc. Icon 628 may include an integrally molded symbol and is preferably made of plastic.

Figure 16:
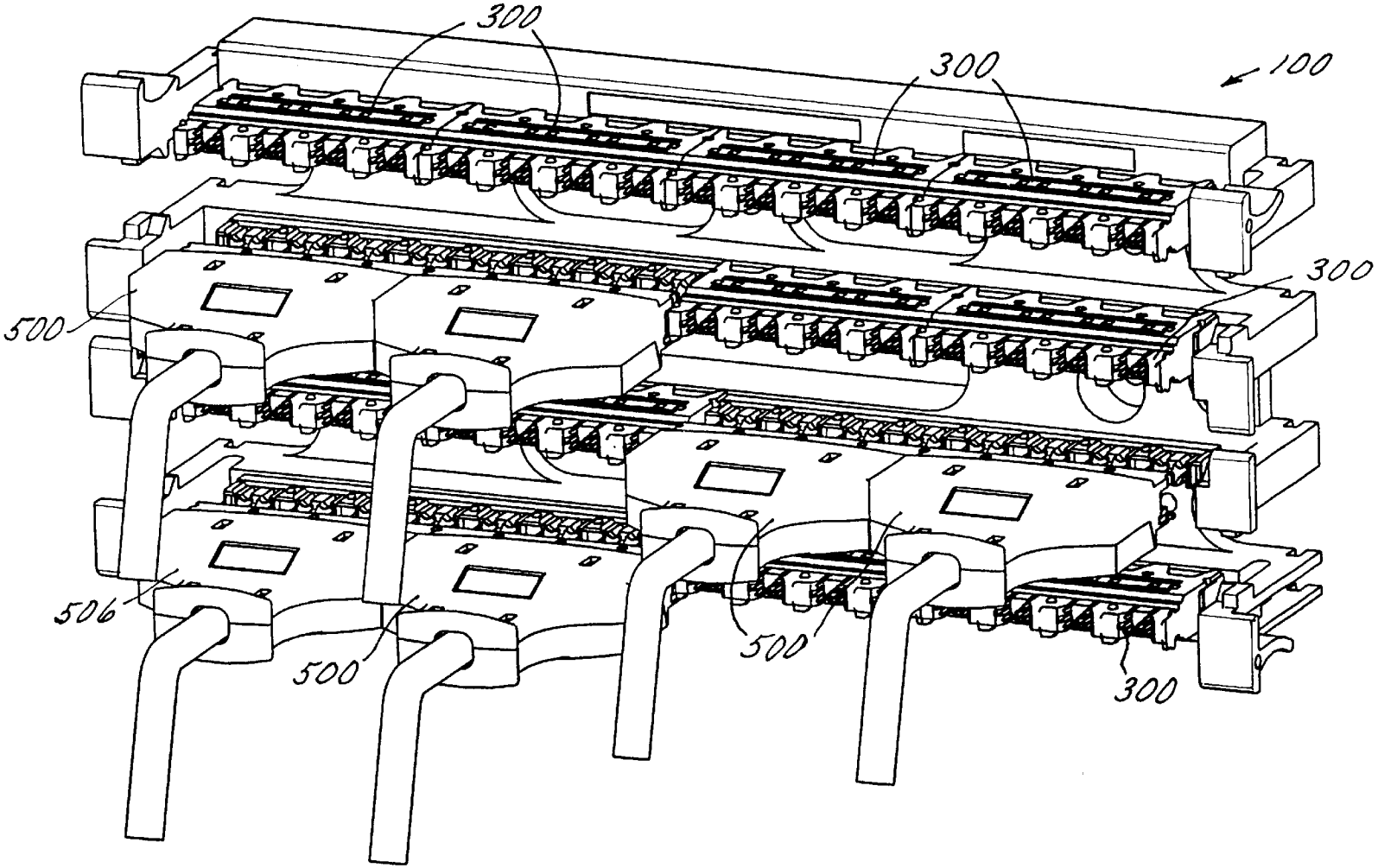
FIG. 16 is a perspective view of a plurality of plugs mounted to a plurality of connecting blocks of the wire connecting system.

As shown in FIG. 16, any number of wiring strips 108 may be employed with the appropriate base 102. Further, any number of connector blocks 300 may be employed with appropriate wire strips 108. Plugs 500 may be plugged onto blocks in varying combinations to achieve desired electrical connections within wiring connecting systems and/or between wiring connecting systems.

While the preferred embodiments have been shown and described, various modifications and substitutions may be made thereto without departing from the spirit and scope of the invention. Accordingly, it is to be understood that the present invention has been described by way of illustration and not limitation.

What is claimed is:

1. A wiring connecting system comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding a portion of said pair of contacts;

a wire strip mountable to said connecting block, said wire strip having a plurality of first and second posts alternating along its length, said first posts and said second posts defining an opening therebetween to receive a wire, said opening being aligned with a contact in said connecting block;

each of said second posts of said wire strip includes an open top and an internal cavity.

2. A wiring connecting system as in claim 1, wherein:

said barriers include a pair of depending legs, each said depending leg being seated adjacent another said depending leg of another said barrier in said internal cavity.

3. A wiring connecting system comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding all sides of a central portion of said pair of contacts, each of said contacts having a midpoint located an equal distance between distal ends of said contact along a longitudinal axis of said contact, said central portion including said midpoint, wherein:

said body portion has extending arms and depending legs.

4. A wiring connecting system as in claim 3, wherein:

each of said extending arms extends into said second teeth and is positioned within said second teeth adjacent to said extending arms of another said barrier.

5. A wiring connecting system comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding a portion of said pair of contacts;

at least one of said second teeth having a protrusion extending outward therefrom.

6. A wiring connecting system as in claim 5, wherein:

said protrusions are cylindrical.

7. A wiring connecting system comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding all sides of a central portion of said pair of contacts, each of said contacts having a midpoint located an equal distance between distal ends of said contact along a longitudinal axis of said contact, said central portion including said midpoint, wherein:

said opposed side walls of said housing include an aperture.

8. A wiring connecting comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, one of said opposed side walls of said housing including an aperture;

each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding a portion of said pair of contacts;

wherein said barrier includes a body having opposed sides, one said side having an extension protruding therefrom, said extension positioned in said aperture.

9. A wiring connecting system as in claim 1, wherein:

each said second post includes a front wall and back wall, said front wall and said back wall each having a protruding member; and each said side wall of said housing includes a plurality of holes, said protruding member being seated in said hole when said connecting block is mounted to said wire strip.

10. A wiring connecting system comprising:

a connecting block for housing a plurality of electrical contacts, said connecting block having:

a housing of an insulative material including opposed sidewalls, an upper end and a lower end, said upper end including a plurality of first and second teeth alternating along its length, said first teeth and said second teeth defining a space therebetween to receive a wire, each said electrical contact being partially disposed within said space, said contacts on either side of said first teeth defining a pair;

a plurality of barriers for electrically shielding pairs of said electrical contacts, said barriers being disposed within said housing, each said barrier having a body portion defining an enclosed interior space, said pair of contacts being positioned within said body portion, said body portion surrounding a portion of said pair of contacts;

wherein each of said first teeth includes a top wall, a front wall, a rear wall and opposed end walls, a first angled surface connecting said top wall to said front wall, a second angled surface connecting said top wall to said rear wall, a third angled surface connecting said top surface to one of said end walls, and a fourth angled surface connected to the other of said end walls.

11. A wiring connection system as in claim 1, wherein:

each said first post includes front and rear walls, opposed end walls and a top wall, a first angled surface connecting said top wall to said front wall, a second angled surface connecting said top wall to said rear wall, a third angled surface connecting said top surface to one of said end walls, and a fourth angled surface connected to the other of said end walls.

12. A plug for connecting a cable having a plurality of wires to a connecting block, the connecting block having a housing for retaining a plurality of electrical contacts, the housing including opposed sidewalls and opposed upper and lower ends, the upper end including a plurality of first and second teeth alternating along its length, the second teeth having a greater width than the first teeth, the first teeth and the second teeth defining a space therebetween, each electrical contact being partially disposed within the space, comprising:

a housing portion having a first end, a second end and a hollow interior, said first end having a hole to receive the cable, said second end being mountable to the upper end of the connecting block; and a plurality of electrical connectors disposed within said interior, each electrical connector having a termination end for electrically connecting said connector to a wire, and a connecting end for electrically connecting said connector to the electrical contact disposed within the connecting block, said electrical connectors being aligned with the spaces between the first and second teeth of the connecting block, said electrical connectors being spaced apart in pairs, said pairs having a greater space between said pairs than within said pairs, wherein said plurality of electrical connectors comprises first electrical connectors having first wire clips for receiving and establishing electrical connection with a wire and second electrical connectors having second wire clips for receiving and establishing electrical connection with a wire, said first and said second electrical connectors being disposed in alternating fashion within said housing, said first wire clips being positioned in a first plane and said second wire clips being positioned in a second plane different from said first plane.

13. A plug as in claim 12, wherein:

said housing portion includes a first housing portion and a second housing portion, said second housing portion being matable to said first housing portion.

14. A plug as in claim 13, wherein:

said first housing portion includes a pair of resilient arms extending inward; and said second housing portion includes a locking protrusion extending inward, said resilient arms receiving said locking protrusion therebetween when said first housing portion is mated to said second housing portion.

15. A plug as in claim 12, wherein:

said first end comprises a handle portion which tapers to said second end.

16. A plug as in claim 12, wherein:

said second end includes opposed depending walls, said walls receiving the connecting block therebetween.

17. A plug as in claim 12, wherein:

one of said opposed depending walls includes a plurality of holes, each of said holes receiving a protrusion disposed on the second teeth of the connecting block.

18. A plug for connecting a cable having a plurality of wires to a connecting block, the connecting block having a housing for retaining a plurality of electrical contacts, the housing including opposed sidewalls and opposed upper and lower ends, the upper end including a plurality of first and second teeth alternating along its length, the first teeth and the second teeth defining a space therebetween, each electrical contact being partially disposed within the space, the plug comprising:

a housing portion having a first end, a second end and a hollow interior, said first end having a hole to receive the cable, said second end being mountable to the upper end of the connecting block; and a plurality of electrical connectors disposed within said interior, each electrical connector having a termination end for electrically connecting said connector to a wire, and a connecting end for electrically connecting said connector to the electrical contact disposed within the connecting block, said electrical connectors being aligned with the spaces between the first and second teeth of the connecting block, said electrical connectors being spaced apart in pairs, said plurality of electrical connectors comprises first electrical connectors and second electrical connectors, said first and said second electrical connectors being disposed in alternating fashion within said housing, said first electrical connectors being J shaped, and said second electrical connectors being C shaped.

19. A plug as in claim 18, wherein:

said first housing portion includes a first inner wall having first contoured slots and a second inner wall inward of said first inner wall, said second inner wall having second contoured slots, said first electrical connectors being seated in said first contoured slots, said second electrical connectors being seated in said second contoured slots.

20. A plug as in claim 19, wherein:

said second housing portion includes a block portion having a plurality of retention slots for retaining wires and for partially retaining said first and said second electrical connectors.

21. A plug as in claim 12, wherein:

said housing portion includes opposed sides; and a shield is disposed on one of said sides.

22. A plug for connecting a cable having a plurality of wires to a connecting block, the connecting block having a housing for retaining a plurality of electrical contacts, the housing including opposed sidewalls and opposed upper and lower ends, the upper end including a plurality of first and second teeth alternating along its length, the first teeth and the second teeth defining a space therebetween, each electrical contact being partially disposed within the space, comprising:

a housing portion having a first end, a second end and a hollow interior, said first end having a hole to receive the cable, said second end being mountable to the upper end of the connecting block; and a plurality of electrical connectors disposed within said interior, each electrical connector having a termination end for electrically connecting said connector to a wire, and a connecting end for electrically connecting said connector to the electrical contact disposed within the connecting block, said electrical connectors being aligned with the spaces between the first and second teeth of the connecting block, wherein said plurality of electrical connectors comprises first electrical connectors having first wire clips for receiving and establishing electrical connection with a wire and second electrical connectors having second wire clips for receiving and establishing electrical connection with a wire, said first wire clips being positioned in a first plane and said second wire clips being positioned in a second plane different from said first plane.

* * * * *

UNITED STATES PATENT AND TRADEMARK OFFICE

CERTIFICATE OF CORRECTION

PATENT NO. : 6,346,005 B1
DATED : February 12, 2002
INVENTOR(S) : Viklund et al.

It is certified that error appears in the above-identified patent and that said Letters Patent is hereby corrected as shown below:

Title page,
Item [57], ABSTRACT,
Line 23, after "second teeth" delete "have" and insert therefor -- having --

Column 2,
Line 51, after "embodiment" insert therefor -- , --

Column 4,
Line 3, after "plurality" and insert therefor -- of --

Column 5,
Line 13, after "rounded" delete "comers" and insert therefor -- corners --

Column 7,
Line 48, after "Handle" delete "ends" and insert therefor -- end --

Column 10,
Line 62, after "connecting" insert therefor -- system --

Signed and Sealed this

Thirty-first Day of May, 2005

JON W. DUDAS
*Director of the United States Patent and Trademark Office*